US007360988B2

(12) United States Patent
Lee et al.

(10) Patent No.: US 7,360,988 B2
(45) Date of Patent: Apr. 22, 2008

(54) METHODS AND APPARATUS FOR ASSEMBLING TURBINE ENGINES

(75) Inventors: Ching-Pang Lee, Cincinnati, OH (US); Wenfeng Lu, Mason, OH (US); Douglas Marti Fortuna, Cincinnati, OH (US); Jakub Roniewicz, Warsaw (PL); Robert Andrzej Gniazdowski, Warsaw (PL)

(73) Assignee: General Electric Company, Schenectady, NY (US)

( * ) Notice: Subject to any disclaimer, the term of this patent is extended or adjusted under 35 U.S.C. 154(b) by 200 days.

(21) Appl. No.: 11/297,672

(22) Filed: Dec. 8, 2005

(65) Prior Publication Data

US 2007/0134088 A1 Jun. 14, 2007

(51) Int. Cl.
*F01D 25/14* (2006.01)

(52) U.S. Cl. ..... 415/116; 29/889.22; 60/796

(58) Field of Classification Search ..... 415/189, 415/190, 209.2, 209.3, 209.4, 210.1; 60/796, 60/798, 800; 29/889.22
See application file for complete search history.

(56) References Cited

U.S. PATENT DOCUMENTS 3,965,066 A * 6/1976 Sterman et al. ..... 60/800
4,821,522 A * 4/1989 Matthews et al. ..... 60/757
5,417,545 A * 5/1995 Harrogate ..... 415/115
5,470,198 A * 11/1995 Harrogate et al. ..... 415/115
6,227,798 B1 5/2001 Demers et al.
6,398,488 B1 6/2002 Solda et al.
6,612,811 B2 9/2003 Morgan et al.
6,684,626 B1 2/2004 Orlando et al.
6,893,217 B2 5/2005 Brainch et al.
6,921,246 B2 7/2005 Brainch et al.
6,935,837 B2 8/2005 Moniz et al.
6,969,233 B2 11/2005 Powis et al.
6,983,608 B2 1/2006 Allen, Jr. et al.

* cited by examiner

*Primary Examiner*—Edward K. Look
*Assistant Examiner*—Nathan Wiehe
(74) *Attorney, Agent, or Firm*—William Scott Andes; Armstrong Teasdale LLP

(57) ABSTRACT

A method facilitates the assembly of a gas turbine engine. The method comprises providing a turbine nozzle including an inner band, an outer band, and at least one vane extending between the inner and outer bands, wherein the vane includes a first sidewall and a second sidewall connected together at a leading edge and a trailing edge and coupling the turbine nozzle to a combustor that includes a plurality of circumferentially-spaced cooling openings that are oriented with respect to the turbine nozzle such that cooling air discharged therefrom during engine operation is biased towards the vane leading edge.

19 Claims, 6 Drawing Sheets

METHODS AND APPARATUS FOR ASSEMBLING TURBINE ENGINES

BACKGROUND OF THE INVENTION

This invention relates generally to turbine engines and more particularly, to methods and apparatus for assembling gas turbine engines.

Known gas turbine engines include combustors which ignite fuel-air mixtures which are then channeled through a turbine nozzle assembly towards a turbine. At least some known turbine nozzle assemblies include a plurality of arcuate nozzle segments arranged circumferentially. At least some known turbine nozzles include a plurality of circumferentially-spaced hollow airfoil vanes coupled by integrally-formed inner and outer band platforms. More specifically, the inner band forms a portion of the radially inner flowpath boundary and the outer band forms a portion of the radially outer flowpath boundary.

Within known engine assemblies, an interface defined between the turbine nozzle and an aft end of the combustor is known as a fish-mouth seal. More specifically, within such engine assemblies, leading edges of the turbine nozzle outer and inner band platforms are generally axially aligned with respect to a leading edge of each airfoil vane extending therebetween. Accordingly, in such engine assemblies, when hot combustion gases discharged from the combustor approach the nozzle vane leading edge, a pressure or bow wave reflects from the vane leading edge stagnation and propagates a distance upstream from the nozzle assembly, causing circumferential pressure variations across the band leading edges and a non-uniform gas pressure distribution. The pressure variations may cause localized nozzle oxidation and/or localized high temperature gas injection, each of which may decrease engine efficiency. Moreover, such pressure variations may also cause the vane leading edge to operate at an increased temperature in comparison to the remainder of the vane.

BRIEF SUMMARY OF THE INVENTION

In one aspect, a method for assembling a gas turbine engine is provided. The method comprises providing a turbine nozzle including an inner band, an outer band, and at least one vane extending between the inner and outer bands, wherein the vane includes a first sidewall and a second sidewall connected together at a leading edge and a trailing edge and coupling the turbine nozzle to a combustor that includes a plurality of circumferentially-spaced cooling openings that are oriented with respect to the turbine nozzle such that cooling air discharged therefrom during engine operation is biased towards the vane leading edge.

In another aspect, a combustion assembly for a gas turbine engine is provided. The combustion assembly includes a combustor and a turbine nozzle assembly. The combustor includes a plurality of circumferentially-spaced cooling openings. The turbine nozzle assembly is downstream from and in flow communication with the combustor. The nozzle assembly includes an outer band, an inner band, and at least one vane extending between the outer and inner bands. The outer band and the inner band each include a leading edge. The at least one vane includes a first sidewall and a second sidewall connected together at a leading edge and a trailing edge. The at least one vane leading edge is positioned downstream from the inner and outer band leading edges. The plurality of circumferentially-spaced cooling openings are configured to bias cooling air discharged therefrom towards the nozzle vane leading edge.

In a further aspect, a gas turbine engine is provided. The engine includes a combustor and a turbine nozzle assembly. The combustor includes a plurality of circumferentially-spaced cooling openings. The turbine nozzle assembly is coupled to an aft end of the combustor and includes an outer band, an inner band, and at least one vane extending between the outer and inner bands. The at least one vane includes a first sidewall and a second sidewall connected together at a leading edge and a trailing edge. The plurality of circumferentially-spaced cooling openings are configured to bias cooling air discharged therefrom towards the nozzle vane leading edge.

DETAILED DESCRIPTION OF THE INVENTION

Figure 1:
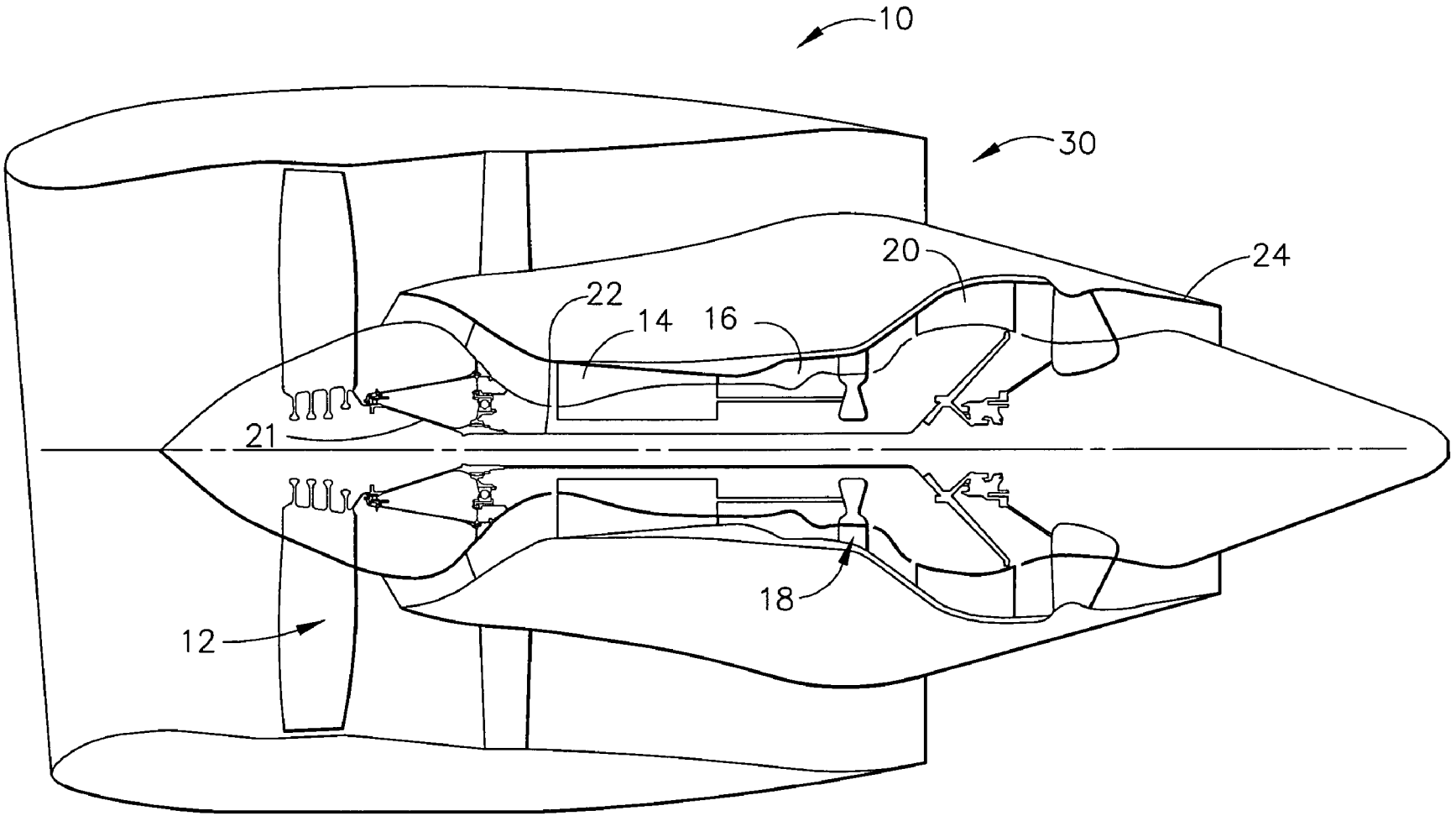
FIG. 1 is a schematic illustration of an exemplary gas turbine engine.

FIG. 1 is a schematic illustration of an exemplary gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 21, and compressor 14 and turbine 18 are coupled by a second shaft 22. In one embodiment, gas turbine engine 10 is an LM2500 engine commercially available from General Electric Aircraft Engines, Cincinnati, Ohio. In another embodiment, gas turbine engine 10 is a CFM engine commercially available from General Electric Aircraft Engines, Cincinnati, Ohio.

In operation, air flows through low pressure compressor 12 supplying compressed air from low pressure compressor 12 to high pressure compressor 14. The highly compressed air is delivered to combustor 16. Airflow from combustor 16 is channeled through a turbine nozzle (not shown in FIG. 1) to drive turbines 18 and 20, prior to exiting gas turbine engine 10 through an exhaust nozzle 24.

Figure 2:
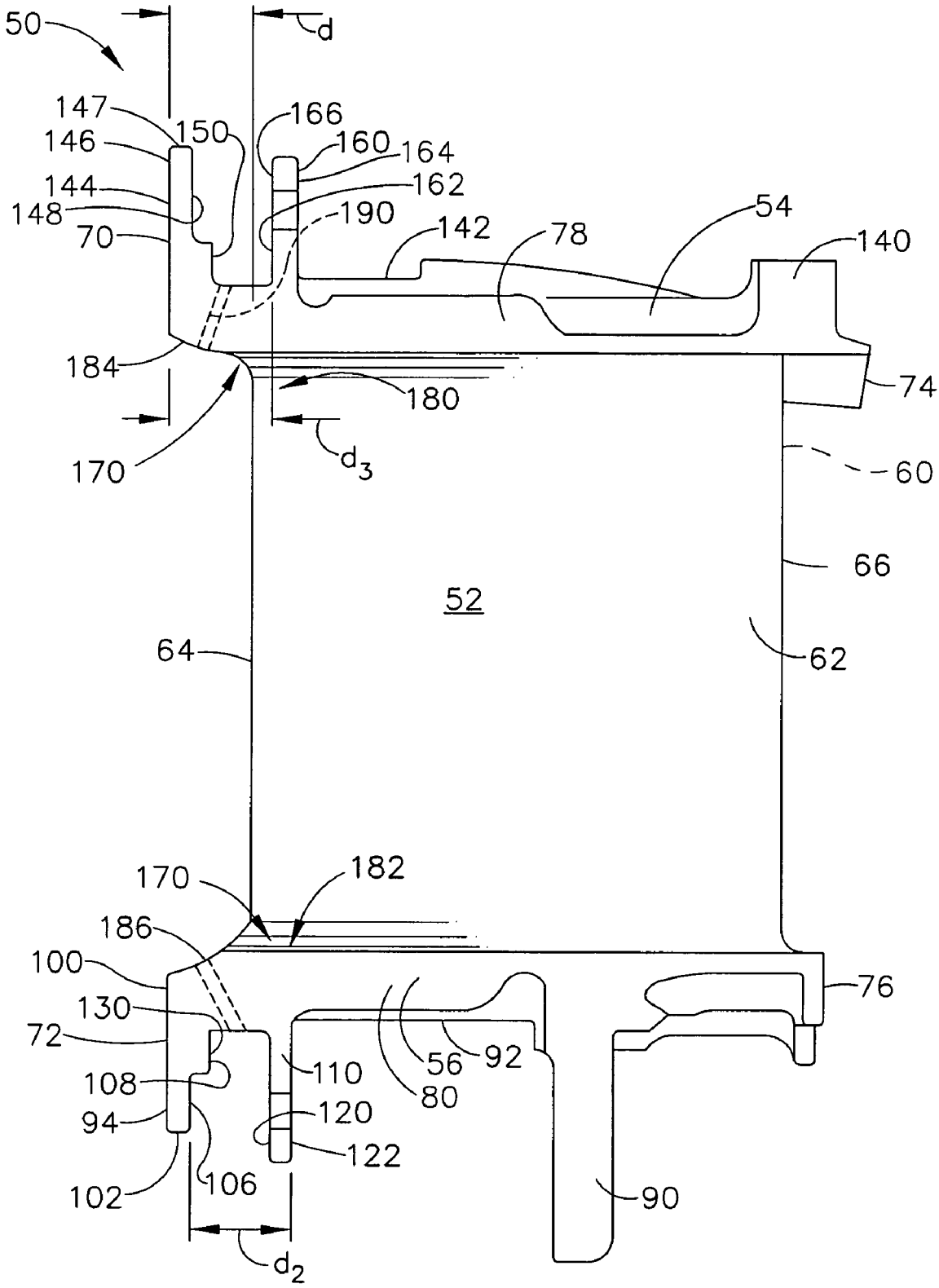
FIG. 2 is a side view of an exemplary turbine nozzle that may be used with the gas turbine engine shown in FIG. 1.
Figure 3:
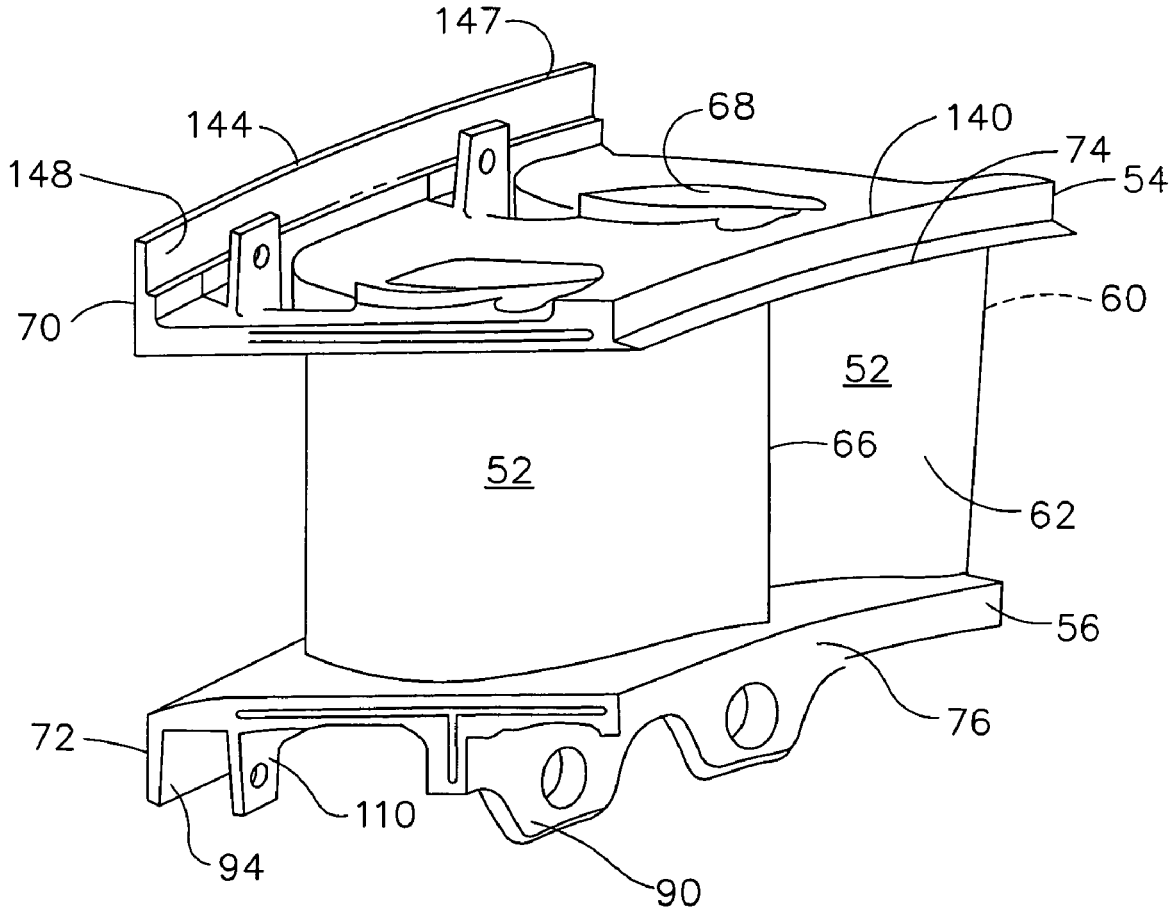
FIG. 3 is a perspective view of the turbine nozzle shown in FIG. 2.

FIG. 2 is a side view of an exemplary turbine nozzle 50 that may be used with a gas turbine engine, such as turbine engine 10 (shown in FIG. 1). FIG. 3 is a perspective view of turbine nozzle 50. In the exemplary embodiment, nozzle 50 is one segment of a plurality of segments that are positioned circumferentially to form a nozzle assembly (not shown) within the gas turbine engine. Nozzle 50 includes at least one airfoil vane 52 that extends between an arcuate radially outer band or platform 54, and an arcuate radially inner band or platform 56. More specifically, in the exemplary embodiment, outer band 54 and the inner band 56 are each integrally-formed with airfoil vane 52.

Vane 52 includes a pressure-side sidewall 60 and a suction-side sidewall 62 that are connected at a leading edge 64 and at an chordwise-spaced trailing edge 66 such that a cooling cavity 68 is defined between sidewalls 60 and 62. Vane sidewalls 60 and 62 each extend radially between bands 54 and 56 and in the exemplary embodiment, sidewall 60 is generally concave, and sidewall 62 is generally convex.

Outer and inner bands 54 and 56 each include a leading edge 70 and 72, respectively, a trailing edge 74 and 76, respectively, and a platform body 78 and 80, respectively, extending therebetween. Airfoil vane(s) 52 are oriented such that outer and inner band leading edges 70 and 72, respectively, are each a distance d upstream from airfoil vane leading edge 64. Distance d is variably selected to ensure that leading edges 70 and 72 are upstream from vane leading edge 64, and to facilitate bands 54 and 56 preventing hot gas injections along vane leading edge 64, as described in more detail below.

In the exemplary embodiment, inner band 56 includes an aft flange 90 that extends radially inwardly therefrom. More specifically, flange 90 extends radially inwardly from band 56 with respect to a radially inner surface 92 of band 56. Inner band 56 also includes a forward flange 94 that extends radially inward therefrom. Forward flange 94 is positioned between inner band leading edge 72 and aft flange 90, and extends radially inwardly from band 56. In the exemplary embodiment, an upstream side 100 of forward flange 94 is substantially planar between a radially outermost surface 102 of flange 94 and radially inner surface 92. Moreover, in the exemplary embodiment, a downstream side 106 of flange 94 includes a shoulder 108, such that flange downstream side 106 is substantially planar from flange surface 102 to shoulder 108, and from shoulder 108 to radially inner surface 92.

Inner band 56 also includes a plurality of circumferentially-spaced radial tabs 110 that extend radially inwardly therefrom. More specifically, in the exemplary embodiment, the number of radial tabs 110 is the same as the number of vanes 52. In the exemplary embodiment, each tab 110 includes a substantially parallel upstream and downstream surfaces 120 and 122, respectively. Radial tabs 110 are spaced a distance $d_2$ downstream from forward flange 94 such that a retention channel 130 is defined between each radial tab 110 and forward flange 94.

In the exemplary embodiment, outer band 54 includes an aft flange 140 that extends generally radially outwardly therefrom. More specifically, flange 140 extends radially outwardly from band 54 with respect to a radially outer surface 142 of band 54. Outer band 54 also includes a forward flange 144 that extends radially outward therefrom. Forward flange 144 is positioned between outer band leading edge 70 and aft flange 140, and extends radially inwardly from band 54. In the exemplary embodiment, an upstream side 146 of forward flange 144 is substantially planar between a radially outermost surface 147 of flange 144 and outer surface 142. Moreover, in the exemplary embodiment, a downstream side 148 of flange 144 includes a shoulder 150, such that flange downstream side 148 is substantially planar from flange surface 147 to shoulder 150, and from shoulder 150 to radially outer surface 142.

Outer band 54 also includes a plurality of circumferentially-spaced radial tabs 160 that extend radially outwardly therefrom. More specifically, in the exemplary embodiment, the number of radial tabs 160 is the same as the number of vanes 52. In the exemplary embodiment, each tab 160 includes substantially parallel upstream and downstream surfaces 162 and 164, respectively. Radial tabs 160 are spaced a distance $d_3$ downstream from forward flange 144 such that a retention channel 166 is defined between each radial tab 160 and forward flange 144. In the exemplary embodiment, channels 166 are approximately the same size as channels 130.

Turbine nozzle 50 also includes a plurality of leading edge fillets 170. Fillets 170 are generally larger than fillets used with known turbine nozzles and extend between outer platform 54 and vane 52 in a tip area 180 of each vane leading edge 64, and between inner platform 56 and vane 52 in a hub area 182 of each vane leading edge 64. Specifically, within tip area 180, fillets 170 are blended from vane leading edge 64 across a radially inner surface 184 of outer platform 54 and towards outer band leading edge 70. Moreover, within hub area 182, fillets 170 are blended from vane leading edge 64 across a radially outer surface 186 of inner platform 56 and towards inner band leading edge 72. Accordingly, nozzle vane leading edge 64 is enlarged within both hub area 182 and tip area 180 such that fillets 170 facilitate accelerating the flow passing thereby.

In the exemplary embodiment, fillets 170 are formed with a plurality of cooling openings 190 that extend through fillets 170 and are configured to discharge cooling air inwardly into the boundary flow flowing over vane 52. Specifically, each cooling opening 190 is oriented towards a pitch-line of vane 52 and such that openings 190 facilitate energizing the flow momentum in the boundary layer, such that the formation of horseshoe vortices upstream from leading edge 64 is facilitated to be reduced. The reduction in the formation of the horseshoe vortices facilities improving aerodynamic efficiency. Moreover, the plurality of cooling openings 190 also facilitate reducing surface heating and an operating temperature of vane 52.

During operation, the location of inner and outer bands 56 and 54, respectively, with respect to vane leading edge 64 facilitates reducing hot gas injections along vane leading edge 64. Rather, the combination of enlarged fillets 170 and cooling holes 190 facilitates accelerating the flow and energizing the flow momentum in the boundary layer, such that the formation of horseshoe vortices are facilitated to be reduced. As a result, aerodynamic efficiency is facilitated to be improved and the operating temperature of nozzle airfoil vane 52 is facilitated to be reduced. As such, a useful life of turbine nozzle 50 is facilitated to be extended.

Figure 4:
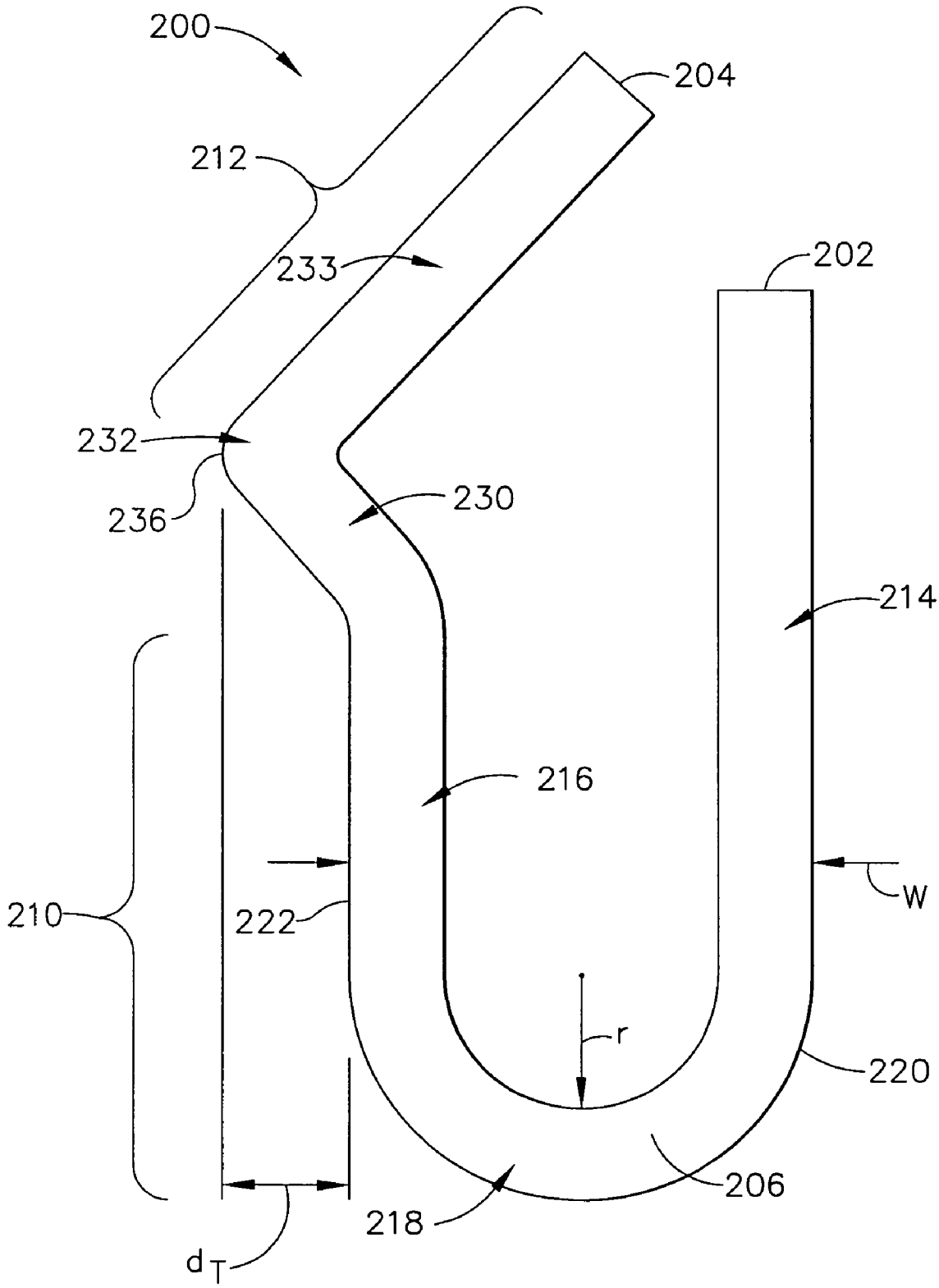
FIG. 4 is an enlarged side view of an exemplary retainer that may be used with the turbine nozzle shown in FIGS. 2 and 3.

FIG. 4 is an enlarged side view of an exemplary retainer 200 that may be used with turbine nozzle 50 (shown in FIGS. 2 and 3). In the exemplary embodiment, retainer 200 is known as a spring clip and is configured to facilitate coupling nozzle 50 to an aft end of combustor 16 in a sealing arrangement as described in more detail below. Retainer 200 includes a pair of opposite ends 202 and 204, and a body 206 extending therebetween. In the exemplary embodiment, body 206 includes an insertion portion 210 and a retention portion 212 that extends integrally from insertion portion 210.

Insertion portion 210 is generally U-shaped and extends from end 204 to insertion portion 210, and retention portion 212 extends from insertion portion 210 to end 204. Accordingly, insertion portion 210 includes a pair of opposed legs 214 and 216 that are connected by an arcuate portion 218. In the exemplary embodiment, portion 218 is substantially semi-circular. Arcuate portion 218 has a radius r that is sized to enable legs 214 and 216 to define a width w of retainer 200, measured with respect to an outer surface 220 and 222 of legs 214 and 216, respectively, that is narrower than a width, i.e., distance $d_2$, of channel 166 or channel 130. Accordingly, insertion portion 210 is sized for insertion within retention channels 166 and 130.

Retention portion 212 includes a first leg 230 that extends obliquely outward from leg 216 to an apex 232 and a second leg 233 that extends obliquely from apex 232 towards leg 214. As such, a tip 236 of apex 232 is a distance $d_T$ from leg outer surface 222.

In the exemplary embodiment, retainer 200 is fabricated from a resilient material that resists deformation. In an alternative embodiment, retainer 200 is fabricated from a shape memory material. In a further alternative embodiment, retainer 200 is fabricated from any material that enables retainer 200 to function as described herein.

Figure 5:
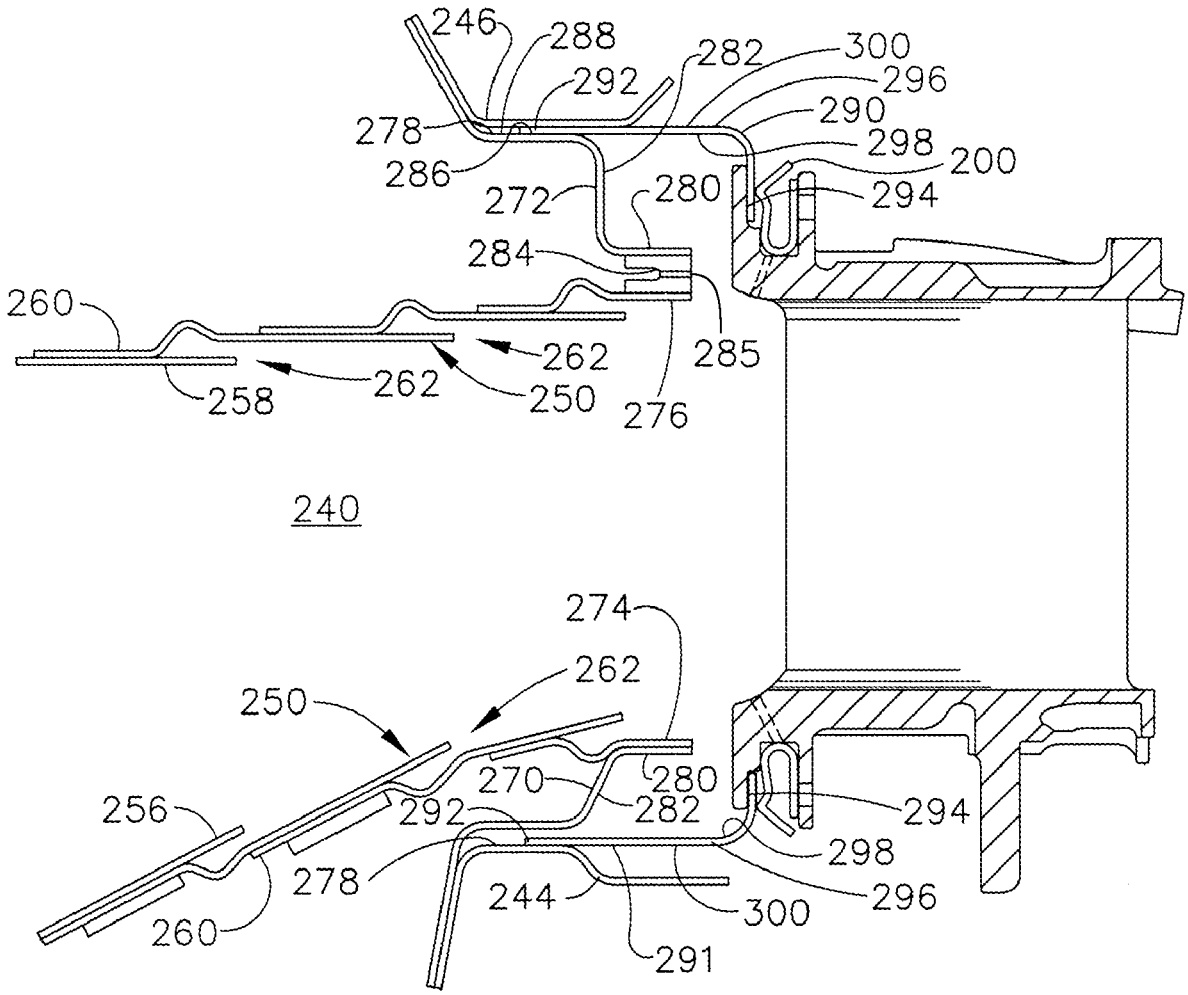
FIG. 5 is a side view of the turbine nozzle shown in FIGS. 2 and 3 coupled to a combustor that may be used with the engine shown in FIG. 1 with the retainer shown in FIG. 4.
Figure 6:
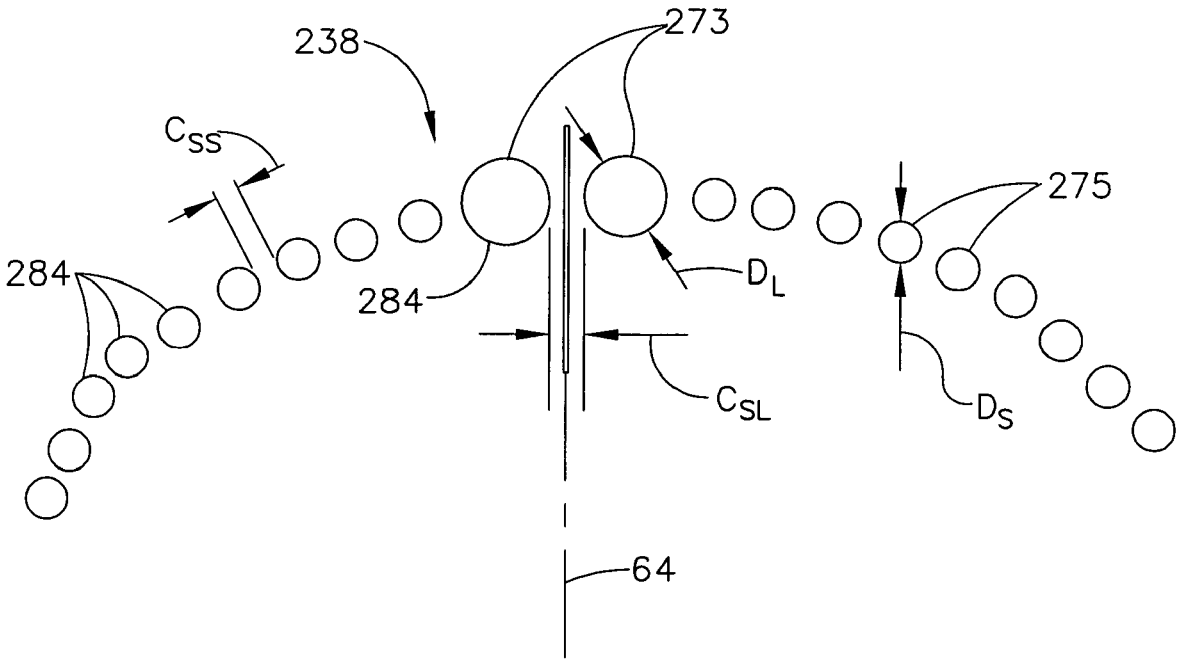
FIG. 6 is a schematic view of a portion of an exemplary combustor liner cooling hole distribution pattern that may be used with the combustor shown in FIG. 5.

FIG. 5 is a side view of turbine nozzle 50 coupled to combustor 16 using retainer 200. FIG. 6 is a schematic view of a portion of an exemplary combustor liner cooling hole distribution pattern 238 that may be used with combustor 16. Combustor 16 includes a combustion zone 240 that is formed by annular, radially inner and radially outer supporting members 244 and 246, respectively, and combustor liners 250. Combustor liners 250 shield the outer and inner supporting members from heat generated within combustion zone 240. More specifically, combustor 16 includes an annular inner liner 256 and an annular outer liner 258. Liners 258 and 256 define combustion zone 240 such that combustion zone 240 extends from a dome assembly (not shown) downstream to turbine nozzle 50. Outer and inner liners 256 and 258 each include a plurality of separate panels 260 which include a series of steps 262, each of which form a distinct portion of combustor liners 250.

Each liner 256 and 258 also includes an annular support flange, or aft flange, 270 and 272, respectively. Specifically, each support flange 270 and 272 couples an aft end 274 and 276 of each respective liner 256 and 258 to supporting members 244 and 246. More specifically, the coupling of each support flange 270 and 272 to each supporting member 244 and 246 forms an annular gap or fishmouth opening 278.

Each support flange 270 and 272 includes a radial portion 280 and a conical datum area 282. In the exemplary embodiment, a plurality of cooling openings or jets 284 extend through an annular ring 285 coupled between radial portion 280 and liner 256. In an alternative embodiment, each radial portion 280 is formed such that openings or jets 284 extend therethrough to facilitate discharging cooling air towards nozzle 50. Jets 284 are arranged in a cooling hole distribution pattern 238 that facilitates optimizing the discharge of cooling flow towards nozzle 50, as is described in more detail below. In the exemplary embodiment, distribution pattern 238 includes a plurality of circumferentially-spaced cooling openings 284. More specifically, in the exemplary embodiment, distribution pattern 238 includes a pair of larger openings 273 having a first diameter $D_L$ and a plurality of smaller openings 275 having a second diameter $D_S$ that is smaller than first diameter $D_L$. In an alternative embodiment, pattern 238 includes a plurality of openings 284 having a plurality of different sized diameters. In another alternative embodiment, distribution pattern 238 includes more or less than two openings 273.

In the exemplary embodiment, openings 273 are centered within pattern 238 and are upstream from, and centered with respect to, nozzle vane leading edge 64. As such, generally, openings 275 extend circumferentially between adjacent vanes 52. Moreover, in the exemplary embodiment, the circumferentially spacing $C_{SL}$ between openings 273 is wider than the circumferential spacing $C_{SS}$ between circumferentially-spaced openings 275. Furthermore, in the exemplary embodiment, openings 284 are substantially symmetrically oriented with respect to each vane leading edge 64. However, as will be appreciated by one of ordinary skill in the art, the shape, the number, diameter, orientation, and circumferential spacing of openings 284 is variably selected to facilitate distribution pattern 238 providing cooling flow towards nozzle 50 as described herein. Specifically, because openings 273 are centered with respect to, and are adjacent vane leading edge 64, additional airflow is directed towards vane leading edge 64. The increased airflow from openings 273 facilitates reducing non-uniform pressure distribution and the formation of horseshoe vortices upstream from vane leading edge 64, while reducing surface heating of vane 52. As a result, openings 284 facilitate improving aerodynamic efficiency of nozzle 50.

Each conical datum area 282 extends integrally outward and upstream from each radial portion 280 such that conical datum area 282 defines a radially inner portion 286 of each fishmouth opening 278. A radial outer portion 288 of each fishmouth opening 278 is defined by each supporting member 244 or 246. Fishmouth opening 278 is used to couple a pair of annular ring interfaces 290 and 291 between combustor 16 and nozzle 50.

In the exemplary embodiment, interfaces 290 and 291 are substantially similar and each has a substantially L-shaped cross-sectional profile and includes an upstream edge 292, a downstream edge 294, and a body 296 extending therebetween. Body 296 includes a radially inner surface 298 and an opposite radially outer surface 300. In the exemplary embodiment, interface upstream edge 292 is securely coupled within fishmouth opening 278 and interface downstream edge 294 is inserted within retention channel 166 such that the portion of body inner surface 298 within channel 166 is positioned against the substantially planar portion of nozzle forward flange 144 extending between shoulder 150 and flange surface 147. Similarly, along inner band 56, the downstream edge 294 of interface 291 is inserted within retention channel 130 such that the portion of body inner surface 298 within channel 130 is positioned against the substantially planar portion of nozzle forward flange 94 extending between shoulder 108 and flange surface 102.

After interfaces 290 and 291 are positioned within channels 166 and 130, respectively, a retainer 200 is inserted within each retention channel 166 and 130 such that leg outer surface 220 is positioned against a respective radial tab 160 and 110. More specifically, when fully inserted within channels 166 and 130, each retainer apex 232 is biased against, and in contact with, interfaces 290 and 291. Specifically, each retainer 200 is positioned in contact against each interface radially outer surface 300 such that interface radially inner surface 298 is biased in sealing contact within each channel 130 and 166 against each respective nozzle forward flange 94 and 144. In an alternative embodiment, retainers 200 are not used to couple interfaces 290 and 291 against flanges 94 and 144, but rather other suitable means for securing interfaces 290 and/or 291 in sealing contact against flanges 94 and 144 may be used, such as, but not limited to, inserting fasteners through radial tabs 110 and/or 166, or bending radial tabs 110 and 166 against flanges 94 and 144.

When the engine is fully assembled, interfaces 290 and 291 provide structural support to combustor 16 and facilitate sealing between combustor 16 and nozzles 50. As such, a mechanically flexible seal arrangement is provided which provides structural stability and support to the aft end of combustor 16. Moreover, the assembly of interface rings 290 and 291 between combustor 16 and nozzle 50 is generally less labor intensive and less time-consuming than the assembly of known seal interfaces used with other gas turbine engines.

In each embodiment, the above-described turbine nozzles include an inner band and an outer band that each extend upstream a distance from the vane leading edge to facilitate reducing hot gas injection along the vane leading edge. Moreover, because each inner and outer band extends upstream from the vane leading edge, each band accommodates enlarged fillets in comparison to known turbine nozzles. The combination of the inner and outer bands, the impingement jets extending through the combustor support flanges, and the cooling openings extending through the fillets facilitates reducing an operating temperature of the nozzle vanes, reducing the formation of horseshoe vortices upstream from each vane leading edge, and improving the aerodynamic efficiency of the nozzle. Moreover, the interface rings extending between the combustor and the turbine nozzle provide structural support to the combustor while being biased in a sealing arrangement with the turbine nozzle. As a result, a useful life of the turbine nozzle is facilitated to be extended in a reliable and cost effective manner.

Exemplary embodiments of turbine nozzles are described above in detail. The interface rings, fillets, and cooling openings and jets are not limited to use with the specific nozzle embodiments described herein, but rather, the such components can be utilized independently and separately from other turbine nozzle components described herein. Moreover, the invention is not limited to the embodiments of the nozzle assemblies described above in detail. Rather, other variations of nozzles assembly embodiments may be utilized within the spirit and scope of the claims.

While the invention has been described in terms of various specific embodiments, those skilled in the art will recognize that the invention can be practiced with modification within the spirit and scope of the claims.

What is claimed is:

1. A method for assembling a gas turbine engine, said method comprising:

providing a turbine nozzle including an inner band, an outer band, and at least one vane extending between the inner and outer bands, wherein the vane includes a first sidewall and a second sidewall connected together at a leading edge and a trailing edge;

coupling the turbine nozzle to a combustor that includes a plurality of circumferentially-spaced cooling openings that are oriented with respect to the turbine nozzle such that cooling air discharged therefrom during engine operation is biased towards the vane leading edge, wherein at least a pair of the plurality of circumferentially-spaced cooling openings have a larger diameter than the remaining circumferentially-spaced cooling openings.

2. A method in accordance with claim 1 wherein coupling the turbine nozzle to a combustor further comprises coupling the turbine nozzle to the combustor such that the plurality of circumferentially-spaced cooling openings facilitate reducing the effects of a pressure bow wave on the nozzle assembly during engine operation.

3. A method in accordance with claim 1 wherein coupling the turbine nozzle to a combustor further comprises coupling the turbine nozzle to the combustor such that the plurality of circumferentially-spaced cooling openings are substantially centered and are symmetrically oriented with respect to the nozzle vane leading edge.

4. A method in accordance with claim 1 wherein coupling the turbine nozzle to a combustor further comprises coupling the turbine nozzle to the combustor such that the pair of the plurality of circumferentially-spaced cooling openings having a larger diameter than the remaining circumferentially-spaced cooling openings are adjacent to, and centered about, the nozzle vane leading edge.

5. A method in accordance with claim 1 wherein coupling the turbine nozzle to a combustor further comprises coupling the turbine nozzle to the combustor such that the plurality of circumferentially-spaced cooling openings facilitate extending a useful life of the turbine nozzle.

6. A combustion assembly for a gas turbine engine, said combustion assembly comprising:

a combustor comprising a plurality of circumferentially-spaced cooling openings at least a pair of said plurality of cooling openings have a diameter that is larger than a diameter of said remaining plurality of circumferentially-spaced openings; and a turbine nozzle assembly downstream from and in flow communication with said combustor, said nozzle assembly comprising an outer band, an inner band, and at least one vane extending between said outer and inner bands, said outer band and said inner band each comprising a leading edge, said at least one vane comprising a first sidewall and a second sidewall connected together at a leading edge and a trailing edge, said at least one vane leading edge positioned downstream from said inner and outer band leading edges, said plurality of circumferentially-spaced cooling openings configured to bias cooling air discharged therefrom towards said nozzle vane leading edge.

7. A turbine engine nozzle assembly in accordance with claim 6 wherein said plurality of circumferentially-spaced cooling openings comprise at least one opening having a larger diameter than said remaining circumferentially-spaced cooling openings.

8. A turbine engine nozzle assembly in accordance with claim 7 wherein said at least one opening having a larger diameter is substantially centered with respect to, and upstream from, said nozzle vane leading edge.

9. A turbine engine nozzle assembly in accordance with claim 6 wherein said plurality of circumferentially-spaced cooling openings facilitate reducing surface heating of said nozzle vane.

10. A turbine engine nozzle assembly in accordance with claim 6 wherein said plurality of circumferentially-spaced cooling openings facilitate reducing the effects of a pressure bow wave on said nozzle assembly.

11. A turbine engine nozzle assembly in accordance with claim 6 wherein said plurality of circumferentially-spaced cooling openings facilitate reducing aerodynamic losses of said nozzle assembly.

12. A turbine engine nozzle assembly in accordance with claim 6 wherein said pair of openings are substantially centered about said nozzle vane leading edge.

13. A turbine engine nozzle assembly in accordance with claim 12 wherein a circumferential spacing between said pair of openings is different than a circumferential spacing between adjacent pairs of said remaining circumferentially-spaced openings.

14. A gas turbine engine comprising:

a combustor comprising a plurality of circumferentially-spaced cooling openings at least a pair of said plurality of circumferentially-spaced cooling openings have a diameter that is larger than a diameter of said remaining circumferentially-spaced openings; and a turbine nozzle assembly coupled to an aft end of said combustor, said nozzle assembly comprising an outer band, an inner band, and at least one vane extending between said outer and inner bands, said at least one vane comprising a first sidewall and a second sidewall connected together at a leading edge and a trailing edge, said plurality of circumferentially-spaced cooling openings configured to bias cooling air discharged therefrom towards said nozzle vane leading edge.

15. A gas turbine engine in accordance with claim 14 wherein said nozzle assembly plurality of circumferentially-spaced cooling openings facilitate reducing the effects of a pressure bow wave on said nozzle assembly.

16. A gas turbine engine in accordance with claim 14 wherein said nozzle assembly plurality of circumferentially-spaced cooling openings facilitate reducing surface heating of said nozzle assembly.

17. A gas turbine engine in accordance with claim 14 wherein said nozzle assembly plurality of circumferentially-spaced cooling openings are substantially centered and are symmetrically oriented with respect to said nozzle vane leading edge.

18. A gas turbine engine in accordance with claim 14 wherein said at least a pair of openings are separated by a first circumferential distance, adjacent pairs of said remaining plurality of circumferentially-spaced openings are separated by a second circumferential distance that is different than said first circumferential distance.

19. A gas turbine engine in accordance with claim 14 wherein said nozzle assembly plurality of circumferentially-spaced cooling openings facilitate extending a useful life of said nozzle assembly.

* * * * *